US006018896A

United States Patent [19]

Adamic

[11] Patent Number: 6,018,896

[45] Date of Patent: Feb. 1, 2000

[54] COUPLING DEVICE FOR LOCKING AN EXCAVATION TOOTH ONTO AN ADAPTOR

[75] Inventor: Dwight Adamic, Edmonton, Canada

[73] Assignee: Quality Steel Foundries Ltd., Edmonton, Canada

[21] Appl. No.: 09/046,861

[22] Filed: Mar. 24, 1998

[30] Foreign Application Priority Data

Nov. 13, 1997 [CA] Canada ..... 2219036

[51] Int. Cl.[7] ..... E02F 9/28

[52] U.S. Cl. ..... 37/456; 37/457

[58] Field of Search ..... 37/452, 453, 454, 37/455, 456, 457, 458; 172/699, 701.2; 299/91, 92; 403/355, 379

[56] References Cited

U.S. PATENT DOCUMENTS

| | | | |
|---|---|---|---|
| 564,664 | 7/1896 | Trim et al. . | |
| 2,846,790 | 8/1958 | Davis et al. | 37/457 |
| 2,951,300 | 9/1960 | Ratkowski | 37/457 |
| 3,256,622 | 6/1966 | Hostetter . | |
| 3,410,010 | 11/1968 | Ratkowski . | |
| 4,231,173 | 11/1980 | Davis | 37/456 X |
| 4,282,665 | 8/1981 | Fletcher et al. | 37/457 |
| 5,068,986 | 12/1991 | Jones | 37/457 |
| 5,465,512 | 11/1995 | Livesay et al. | 37/457 |

FOREIGN PATENT DOCUMENTS 2121993 11/1997 Canada .

*Primary Examiner*—Robert E. Pezzuto
*Attorney, Agent, or Firm*—Kohn & Associates

[57] ABSTRACT

The present invention is a coupling device for locking an excavation tooth onto an adaptor. The adaptor and tooth have a passage extending therethrough. The device includes a pin and retainer. The retainer is inserted into the adaptor. The pin includes a retainer seat for engaging the retainer. The retainer seat has a front wall perpendicular to the longitudinal axis of the passage and a back wall which slopes away from the front wall. As the pin is inserted into the passage, the retainer engages the pin until it enters the seat. The front wall then prevents the pin from being retracted from the passage. To remove the pin, force is applied to the driven end of the pin. The pin will continue through the passage while the retainer slides along the sloped back wall of the retainer seat. This arrangement allows for the easy insertion and removal of the pin with a relatively small amount of force.

12 Claims, 4 Drawing Sheets

COUPLING DEVICE FOR LOCKING AN EXCAVATION TOOTH ONTO AN ADAPTOR

FIELD OF THE INVENTION

The present invention relates to the field of excavating teeth and in particular to assemblies for attaching a ground engaging tooth to an adaptor on an excavating tool.

BACKGROUND OF THE INVENTION

At approximately the turn of the 20th century, excavating tools employed excavating teeth with replaceable ground engaging tips known as points. The points were connected to an adaptor attached to the shovel dipper, drag-line bucket or similar tool. An example is disclosed in U.S. Pat. No. 564,664. As the two part assembly became established practice, a number of methods evolved for joining the point to the adaptor. Depending on the conditions, a given adaptor would be re-equipped with 5 to 30 teeth or points to maintain a sharp penetrating edge during excavation. The ease of replacement of the point became important because it minimized the amount of wasted throw-away metal and also minimized the down time of the tool.

The assemblies used to attach a point to the adaptor consisted mainly of two designs, the wedge design and the pin design. In the wedge design, the point is joined to the adaptor by wedges hammered in place. One disadvantage of this method is the wedges would often become dislodged during use of the excavating tool. This design posed serious safety hazards to workers. To prevent this danger, the wedges were often tack-welded in place. However, removal of the wedges was then difficult and time consuming. Another disadvantage of this method is that the removal of the wedge required the drag-line bucket to be turned up on its front end in order to gain access to the wedge.

U.S. Pat. No. 3,256,622 describes a wedge pin assembly used to fasten a point to the adaptor. The wedge pin is received into an open-ended bore. The wedge pin is removed by being hammered through the slot with a specially designed hammer having a head size smaller than the bore size. The wedge pin is designed to cause interference in the bore but still be removable. One disadvantage of this arrangement is the tendency of the wedge to shatter or break during removal causing pieces to jam as well as dangering workers.

Another pin assembly is disclosed in Canadian Patent Application No. 2,121,993. This patent discloses a threaded pin and insert assembly to secure a point onto the adaptor. A threaded insert is placed into the adaptor pin opening. The point is then placed over the adaptor. A lock washer is concentrically placed over the pin opening on the point. The pin is screwed into the insert. Disadvantages of this assembly include the loosening of the pin from the insert while the point-adaptor assembly is in use, the cumbersome and relatively complex design, and the longer point replacement time as compared with more conventional teeth.

U.S. Pat. No. 3,410,010 describes a dipper tooth having a detent and key assembly inserted into a passage in the tooth and adaptor. A resilient retaining member is received into the adaptor. The member has a recess on its lower edge for receiving a metallic insert. The resilient retaining member and insert extend into a passage extending through the adaptor and point. A key having a notch in its upper surface is inserted into the passage. As the key enters the passage, its front end engages a recess in the lower surface of the passage to allow the key to travel past the insert. The key forces the insert upward, compressing the resilient member, until the insert engages the key notch. This arrangement has the disadvantage that when the tooth and adaptor are in use, the key may be repeatly jolted upward against the insert. This movement may compress the resilient member allowing the insert to disengage the notch on the key. In this manner, the key may fall out of the passage allowing the tooth to come off the adaptor and possibly causing injury to nearby workers. Further, the resilient member has a limited life and, as it loses its resilience, it will not be able to adequately maintain the insert in the key notch.

Locking devices are designed to minimize the down time of the equipment and increase the life of the point and adaptor. With the increase in awareness of worker safety, another important requirement of the point-adaptor assembly is safe and easy installation. The prior art devices do not satisfy these requirements and there therefore is a need for a locking device which is easy, safe, and fast to install and remove.

SUMMARY OF THE INVENTION

It is therefore an object of the present invention to overcome the disadvantages of the prior art. It is a further object to provide an effective device for coupling an excavation tooth to an adaptor on an excavation tool which is easy to insert and remove and reliably retains the tooth on the adaptor during use.

There, therefore, is provided an apparatus for removably coupling an excavation tooth to an adaptor, wherein the excavation tooth and adaptor respectively have first and second passages which are co-extensive and form a common passage when the tooth is operatively coupled to the adaptor, the apparatus comprising: a pin insertable into the common passage and movable between a first position where said pin is partially inserted into the common passage to a second position where the pin is fully inserted into the common passage to a third position where the pin is at least partially removed from the common passage; locking means in the adaptor for retaining said pin in said second position and having at least a portion projecting into the common passage from the adaptor; said pin adapted to be flexible for insertion into the common passage around said projecting portion of said locking means; said pin provided with lock receiving means for receiving at least a portion of said locking means, said lock receiving means adapted to prevent said pin from moving from said second position to said first position and with retaining means cooperating with said locking means for preventing said pin from moving from said second to said third position during use of the tooth while uncooperating with said locking means when said pin is forced to said third position by the application of external force.

BRIEF DESCRIPTION OF THE DRAWINGS

Preferred embodiments of the present invention will now be described and may be better understood when read in conjunction with the following drawings in which.

DETAILED DESCRIPTION OF THE INVENTION

Figure 1:
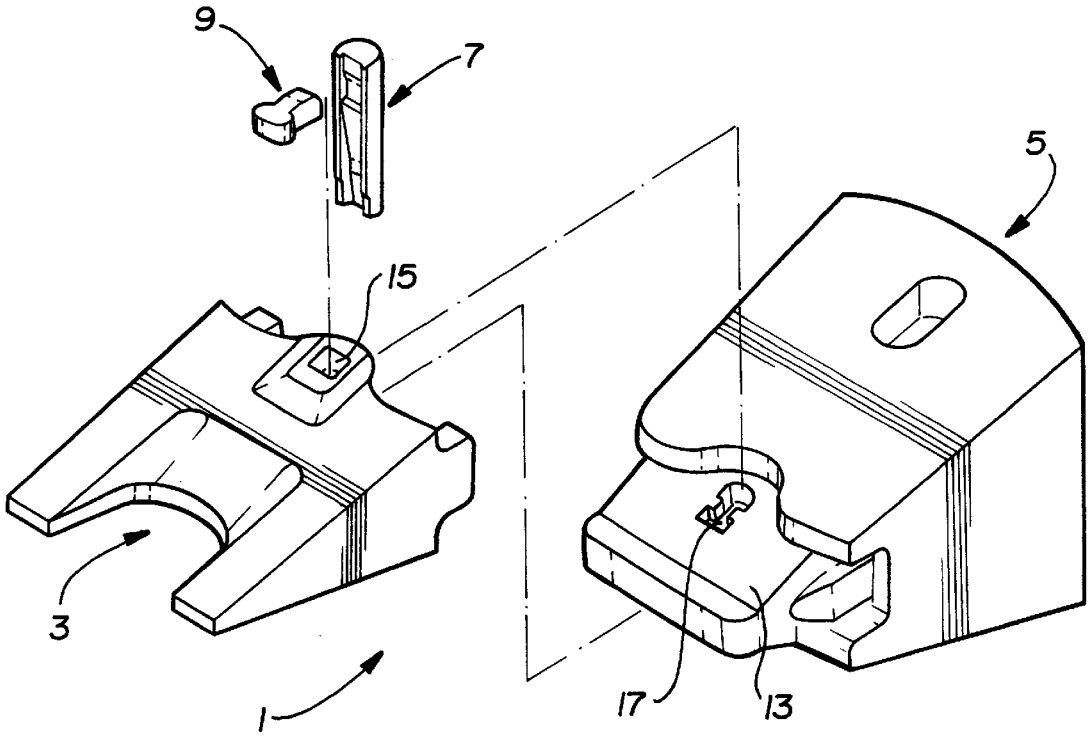
FIG. 1 is an exploded view of the elements of one embodiment of the present coupling device.

With reference to the Figures, there is provided a coupling device 1 for locking an excavation tooth onto an adaptor on an excavation tool. The device 1 comprises a pin 7 and a retainer 9. The pin 7 and retainer 9, inserted into the adaptor 5 and tooth 3, interact to releasably lock the tooth 3 onto the adaptor 5. The pin 7 can be inserted and removed without difficulty for replacing the tooth 3 as needed.

Figure 7:
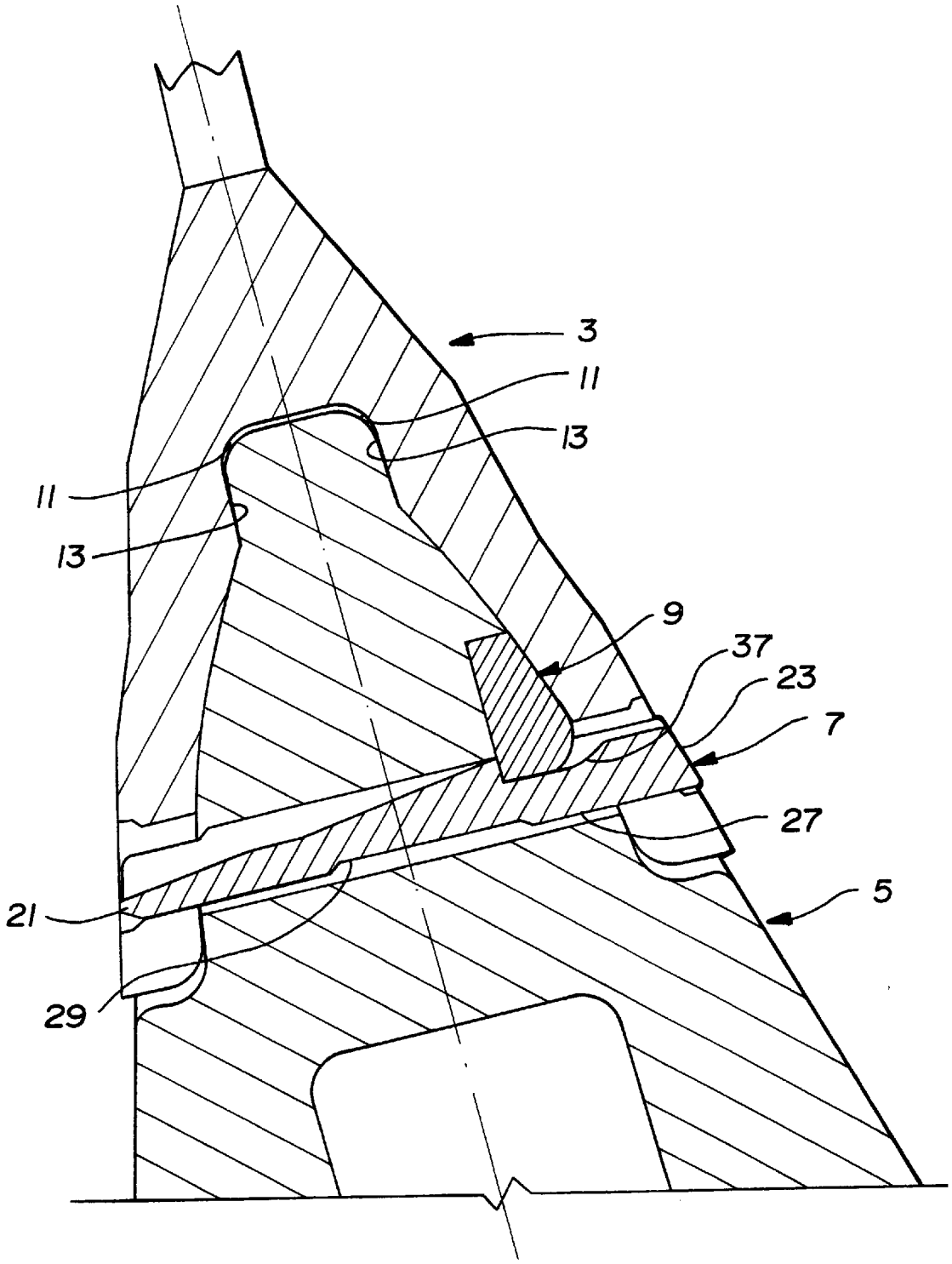
FIG. 7 is a cross-sectional view of the tooth and adaptor assembled using the coupling device shown in FIG. 1.
Figure 8A:
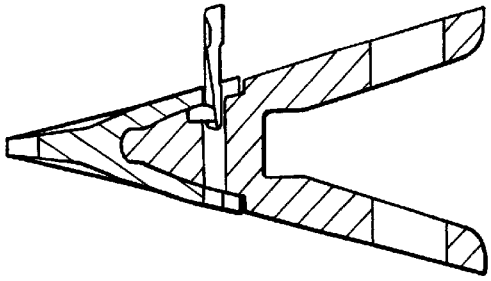
FIG. 8 is a schematic diagram of the method of using the coupling device shown in FIG. 1 to attach a tooth and adaptor.
Figure 8B:
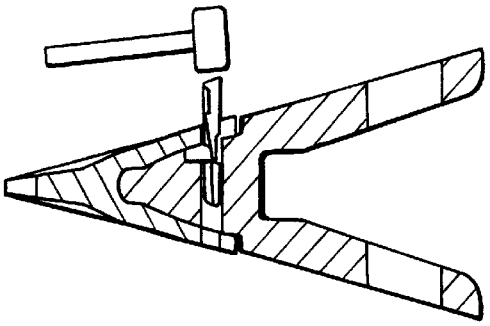
Figure 8C:
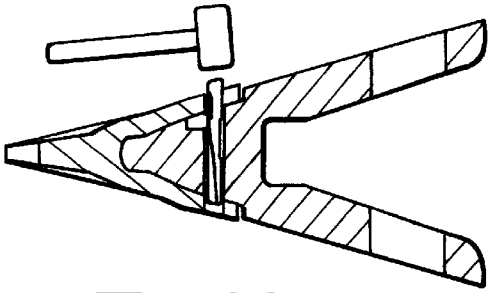
Figure 8D:
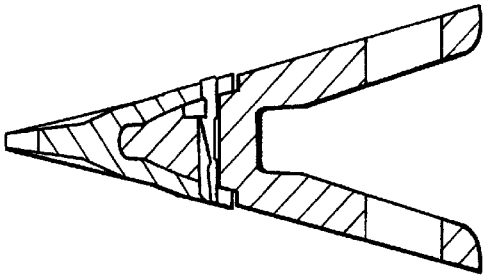
Figure 8E:
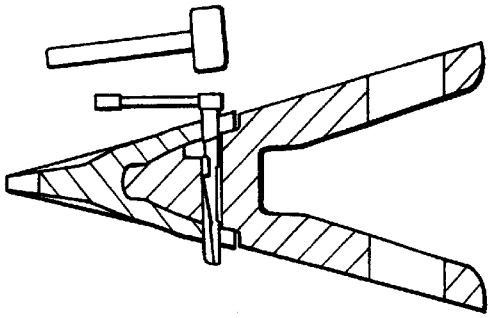
Figure 8F:
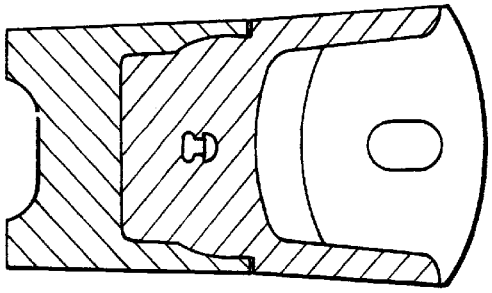

Looking at FIGS. 1 and 7, the excavation tooth 3 is positioned over the forward end of the adaptor 5 in a manner known in the art. A recess in the tooth defined by walls 11 fits over the forward end 13 of the adaptor 5. The tooth 3 has a through going passage extending between openings 15 in opposing surfaces of the tooth. Preferably, the openings 15 are positioned near the rearward edge of the tooth to allow for maximum wear of the tooth before replacement is necessary. The adaptor 5 is provided with a passage 17 extending through its width. When the tooth 3 is properly positioned on the adaptor 5, the passages in the tooth 3 and the adaptor 5 are coextensive.

Figure 3:
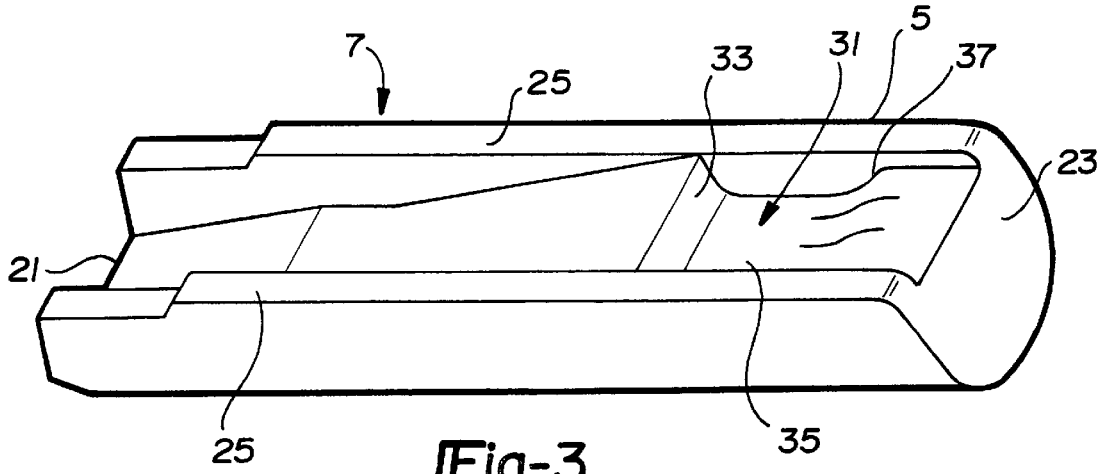
FIG. 3 is a perspective view of the pin of the device shown in FIG. 1.
Figure 4:
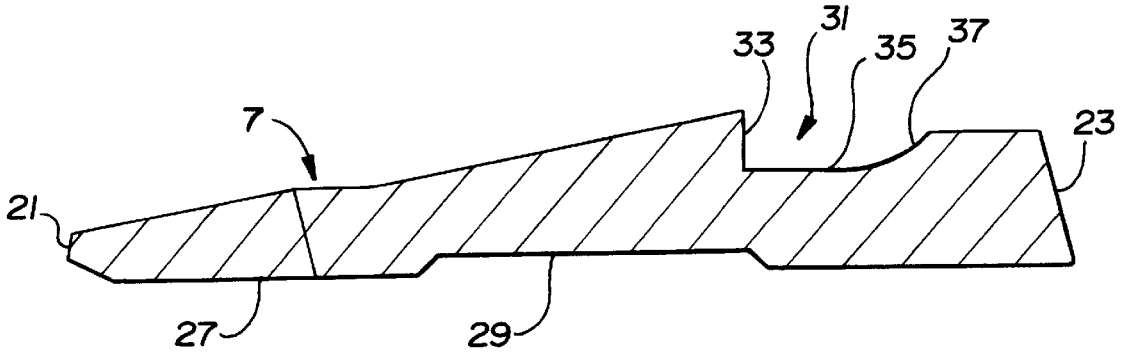
FIG. 4 is a longitudinal cross-section through the pin shown in FIG. 3 illustrating the profile of the retainer engaging surface.
Figure 5:
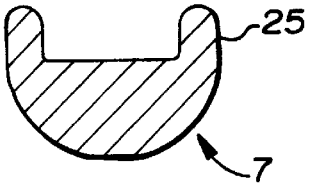
FIG. 5 is a transverse cross-section through the pin shown in FIG. 3 taken along line 5—5.
Figure 6:
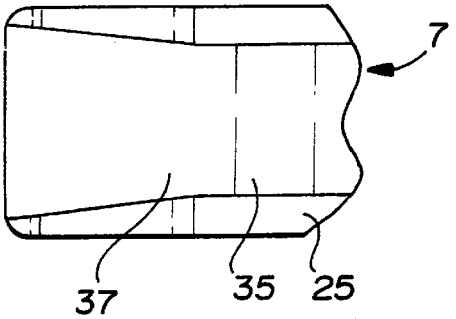
FIG. 6 is a plan view of one end of the pin shown in FIG. 3.

The coupling device 1 includes a pin 7 for engaging the retainer 9 to maintain the tooth 3 on the adaptor 5. The pin 7 shown in detail in FIGS. 3–6 has a general elongated shape. Its main section tapers along its longitudinal axis to one end 21. It has a semi-circular transverse cross-section corresponding to the cross section of the passage 17 in the adaptor thereby reducing or eliminating rotation of the pin 7 in the passage 17. It has a sufficient length to extend between the opposing openings 15 in the tooth 3 to engage the tooth wall when it is fully inserted into the passage 17. The pin 7 may be of any suitable size and shape providing the passage 17 has a corresponding size and shape to allow the pin 7 to be inserted therein and preferably to prevent rotation of the pin 7 in the adaptor passage 17. The main section of the pin 7 is narrow at its insertion end 21 and gradually widens out at the driven end 23 to a width slightly less than the width of the passage 17 to form a tapered shape. The pin includes side edges 25 around its main tapered section, as shown in FIG. 3, for providing for a tight fit in the passage 17 and openings 15 and preventing rotation of the pin 7 as well as providing a channel along the upper surface of the pin 7. On the lower surface 27 of the pin 7 as shown in FIGS. 4 and 7, the middle portion of the pin 7 is indented to form a slight recess 29 extending for approximately one third of the length of the pin 7. This recess 29, along the tapered main section, allows the pin 7 to be somewhat flexible as it is driven into the passage 17. On the upper surface of the pin 7 near its driven end 23, there is a retainer seat 31 shown more clearly in FIGS. 3, 4, and 6. It consists of a recess cut into the upper surface of the pin 7 and has a straight front wall 33 positioned approximately perpendicular to the longitudinal axis of the passage 17. The bottom wall 35 is flat lieing along the longitudinal axis of the passage 17 and the rear wall forms a sloping ramp 37, extending from the back edge of the bottom wall 35 of the seat 31 towards the driven end 23 of the pin 7. Along the sloping ramp 37, the side walls 25 taper outwardly to provide a wider channel therebetween.

Figure 2:
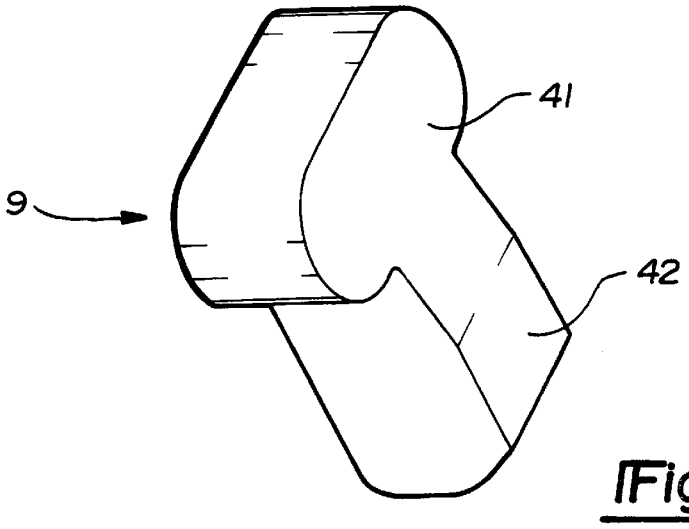
FIG. 2 is a perspective view of the retainer of the device shown in FIG. 1.

A retainer 9 is provided for maintaining the pin 7 in position in the passage 17 during use of the tooth 3 and adaptor 5. The retainer 9 consists of an Ω-shaped block as shown in FIG. 2. A portion of the outer wall 41 of the retainer 9 slopes at an angle corresponding to the angle of the inner wall 11 of the tooth 3. The lower portion 42 of the outer wall 41 of the retainer 9 projects away from the outer wall 41 and meets the bottom wall of the retainer 9 to form a generally rounded corner.

The adaptor 5 has a recess 19 located along its outer wall 13 at the upper edge of the passage 17. The recess 19 shown in FIGS. 1, 7 and 8 has a general Ω-shaped cross-section. This shape allows the retainer 9 to be inserted into the recess 19 and retained in position while the tooth 3 is positioned over the upper end of the adaptor 5 and during insertion of the pin 7. The recess 19 also allows a portion of the retainer 9 to extend into the passage 19. Alternative configurations may be used for receiving and retaining the retainer. Further, the adaptor may include a projection extending from its surface into the passage to act in a manner similar to the retainer. The projection may be an integral part of the adaptor rather than a separate piece as is shown in the preferred embodiment in the Figures.

The present invention is also directed to a method of releasably locking a tooth onto an adaptor as is shown in FIG. 8. The pin 7 is inserted into the passage 17 by placing the insertion end 21 of the pin 7 into the passage opening 15 near the retainer 9. Force is applied to the driven end 23 of the pin 7 to drive the pin 7 into the passage 17 into a fully inserted position shown in FIGS. 7 and 8. The configuration and arrangement of the retainer and pin requires that a relatively small amount of force need be used as compared to conventional devices, for example, a two to three pound hammer is sufficient to generate adequate force to drive the pin in the present invention into place. As the pin 7 travels through the passage 17, the retainer 9 will engage the sloped, upper surface of the pin 7 between the side walls 25 until it reaches the retainer seat 31. Once the retainer 9 enters the retainer seat 31, the front wall 33 of the seat 31 prevents the retainer 9 from moving back down the sloped, upper surface of the pin 7, restricting the pin 7 to unidirectional movement through the passage 17. The pin 17 can not then be retracted from the passage 17. Further, contact between the retainer 9 and the side walls 25 of the retainer seat 31 further prevents movement of the pin 7 in the passage 17. At this point, the pin 7 is fully inserted in the passage 17 engaging both the tooth 3 and the adaptor 5, thereby locking the tooth 3 in place.

The pin 7 may be removed from the passage 17 by using a removing tool 45 and hammer 47 as shown in FIG. 8. A removing tool 45 such as a tool having a handle at one end and, at a right angle to the axis of the handle, a projecting member of a diameter and size less than that of the passage is placed on the driven end 23 of the pin 7. A hammer 47 is used on the outer end of the projecting member of the removing tool 45 to drive the member against the pin 7 and into the passage 17. This force causes the retainer 9 to disengage the retainer seat 31. As the pin 7 is driven through the passage 17, the retainer moves along the sloping ramp 37 at the back of the retainer seat 31. The side walls 25 of the pin 7 taper outward reducing contact with the retainer 9 allowing unobstructed movement of the pin. The pin 7 may then be removed from the passage 17.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following appended claims.

I claim:

1. Apparatus for removably coupling an excavation tooth to an adaptor, wherein the excavation tooth and adaptor respectively have first and second passages which are co-extensive and form a common passage when the tooth is operatively coupled to the adaptor, the apparatus comprising:

a pin adapted for uni-directional insertion into and removal from the common passage and movable between a first position where said pin is partially inserted into the common passage to a second position where the pin is fully inserted into the common passage to a third position where the pin is at least partially removed from the common passage;

locking means in the adaptor for retaining said pin in said second position;

said pin adapted to be flexible for insertion into the common passage around a projecting portion of said locking means;

said pin provided with lock receiving means for receiving said locking means, said lock receiving means adapted to prevent said pin from moving from said second position to said first position and with retaining means cooperating with said locking means for preventing said pin from moving from said second to said third position during use of the tooth while uncooperating with said locking means when said pin is forced to said third position by the application of external force.

2. Apparatus according to claim 1 wherein said locking means comprises a locking tab extending from the adaptor into the passage.

3. Apparatus according to claim 2 wherein said locking tab is receivable in said adaptor.

4. Apparatus according to claim 1 wherein said lock receiving means comprises a recess in said pin.

5. Apparatus according to claim 4 wherein said lock receiving means includes a front wall being positioned substantially perpendicular to the longitudinal axis of the common passage when said pin is in said second position.

6. Apparatus according to claim 5 wherein said lock receiving means includes a back wall sloping away from said front wall.

7. Apparatus according to claim 1 wherein said pin comprises an elongated pin having a main section and side walls, said pin tapering in its main section to a first end and having a second end with said lock receiving means.

8. Apparatus according to claim 7 wherein said pin and the common passage have a corresponding shape adapted to allow said pin to be fully inserted into the passage in only one orientation.

9. A pin for removably coupling an excavation tooth to an adaptor, wherein the excavation tooth and adaptor respectively have first and second passages which are co-extensive and form a common passage when the tooth is operatively coupled to the adaptor, the adaptor including a lock having a projecting portion for securing the pin within the common passage, the pin comprising:

a shaft adapted for uni-directional insertion into and removal from the common passage, the shaft movable between a first position where said shaft is partially inserted into the common passage to a second position where the pin is fully inserted into and locked within the common passage to a third position where the pin is at least partially removed from the common passage, the shaft sufficiently flexible for insertion into the common passage around the projecting portion;

a lock receiving means on the shaft for engagement with the projecting portion, the lock receiving means adapted to prevent the shaft from moving from the second position to the first position and from moving the second to the third position during use while permitting movement of the pin from the second position to the third position under the direct application of an external force to the shaft.

10. The pin according to claim 9 wherein the lock receiving means is a recess in the shaft, the recess having a front wall substantially perpendicular to the longitudinal axis of the shaft.

11. The pin according to claim 10 wherein the lock receiving means is a recess in the shaft, the recess having a back wall sloping away from said front wall.

12. The pin according to claim 9 wherein the shaft includes a narrow lower end and an upper end and the shaft is tapered from the lower end to the upper end.

* * * * *